US012054873B2

(12) United States Patent
Phelps et al.

(10) Patent No.: US 12,054,873 B2
(45) Date of Patent: Aug. 6, 2024

(54) WASHING MACHINE APPLIANCE AND AUGMENTED REALITY CONTROL FEATURES

(71) Applicant: Haier US Appliance Solutions, Inc., Wilmington, DE (US)

(72) Inventors: Stannard Nathan Phelps, Louisville, KY (US); Joshua Reeves, Louisville, KY (US); Sean Simpson, Louisville, KY (US); Mary Joy Frances Cardilino, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/861,604

(22) Filed: Jul. 11, 2022

(65) Prior Publication Data

US 2024/0011211 A1 Jan. 11, 2024

(51) Int. Cl.

| | |
|---|---|
| ***D06F 34/32*** | (2020.01) |
| ***D06F 34/05*** | (2020.01) |
| *D06F 34/04* | (2020.01) |
| *D06F 34/08* | (2020.01) |
| *D06F 34/18* | (2020.01) |
| *D06F 103/04* | (2020.01) |
| *D06F 103/18* | (2020.01) |
| *D06F 105/58* | (2020.01) |

(52) U.S. Cl.

CPC ..... *D06F 34/32* (2020.02); *D06F 34/05* (2020.02); *D06F 34/04* (2020.02); *D06F 34/08* (2020.02); *D06F 34/18* (2020.02); *D06F 2103/04* (2020.02); *D06F 2103/18* (2020.02); *D06F 2105/58* (2020.02)

(58) Field of Classification Search

CPC ..... D06F 34/04; D06F 34/05; D06F 34/28; D06F 34/32

See application file for complete search history.

(56) References Cited

U.S. PATENT DOCUMENTS

| | | | |
|---|---|---|---|
| 8,042,211 | B2 | 10/2011 | Stansel et al. |
| 8,813,288 | B2 | 8/2014 | Bhandwale et al. |
| 8,932,369 | B2 | 1/2015 | Miller et al. |
| 9,080,276 | B2 | 7/2015 | Peterson et al. |
| 9,096,964 | B2 | 8/2015 | Albayrak et al. |

(Continued)

FOREIGN PATENT DOCUMENTS

| | | |
|---|---|---|
| CN | 107574625 A | 1/2018 |
| CN | 106101115 B | 9/2019 |

(Continued)

*Primary Examiner* — Joseph L. Perrin
*Assistant Examiner* — Kevin G Lee
(74) *Attorney, Agent, or Firm* — Dority & Manning, P.A.

(57) ABSTRACT

Methods of operating a washing machine at a remote user interface device in wireless communication with the washing machine appliance may include obtaining an image of the wash basket, generating an overlay representing one or more operating parameters of the washing machine appliance, and displaying the image and the overlay simultaneously on a display of the remote user interface device. The method also includes receiving a control input at the remote user interface device and directing the washing machine appliance based on the control input received at the remote user interface device.

16 Claims, 10 Drawing Sheets

(56) References Cited

U.S. PATENT DOCUMENTS

| | | | | |
|---|---|---|---|---|
| 9,122,549 | B2 | 9/2015 | Canton | |
| 9,200,401 | B2 | 12/2015 | Chung et al. | |
| 9,371,607 | B2 | 6/2016 | Pascualena et al. | |
| 9,863,080 | B2 | 1/2018 | Fugal et al. | |
| 9,890,490 | B2 | 2/2018 | Janke et al. | |
| 10,041,202 | B2 | 8/2018 | Sumer et al. | |
| 10,047,470 | B2 | 8/2018 | Kim et al. | |
| 10,301,762 | B2 | 5/2019 | Sumer et al. | |
| 10,619,286 | B2 | 4/2020 | Pesavento et al. | |
| 10,685,386 | B2 | 6/2020 | Waldron et al. | |
| 11,111,619 | B2 | 9/2021 | Davis | |
| 2008/0178398 | A1 | 7/2008 | Darby et al. | |
| 2017/0053456 | A1 | 2/2017 | Cho et al. | |
| 2019/0392646 | A1* | 12/2019 | Parfenov | G06T 15/20 |
| 2020/0068132 | A1 | 2/2020 | Lin et al. | |
| 2021/0191507 | A1 | 6/2021 | Lee | |

FOREIGN PATENT DOCUMENTS

| | | | | | |
|---|---|---|---|---|---|
| CN | 113529341 | B | * | 1/2024 | D06F 33/34 |
| KR | 2007002638 | A | * | 1/2007 | D06F 33/02 |
| KR | 102181084 | B1 | | 11/2020 | |
| KR | 102268797 | B1 | | 6/2021 | |
| WO | WO2014/191248 | A1 | | 12/2014 | |
| WO | WO2020/050621 | A1 | | 3/2020 | |
| WO | WO2021025194 | A1 | | 2/2021 | |

* cited by examiner

WASHING MACHINE APPLIANCE AND AUGMENTED REALITY CONTROL FEATURES

FIELD OF THE INVENTION

The present subject matter relates generally to washing machine appliances, and more particularly to systems and methods for controlling washing machine appliances.

BACKGROUND OF THE INVENTION

Washing machine appliances generally include a tub for containing wash liquid, e.g., water, detergent, and/or bleach, during operation of such washing machine appliances. A wash basket is rotatably mounted within the wash tub and defines a wash chamber for receipt of articles for washing, and an agitation element is rotatably mounted within the wash basket. Washing machine appliances are typically equipped to operate in one or more modes or cycles, such as wash, rinse, and spin cycles. For example, during a wash or rinse cycle, the wash fluid is directed into the wash tub in order to wash and/or rinse articles within the wash chamber. In addition, the wash basket and/or the agitation element can rotate at various speeds and/or through various lengths of travel to agitate or impart motion to articles within the wash chamber, to wring wash fluid from articles within the wash chamber, etc.

Many operating parameters of the washing machine appliance may be user-selectable, such as a fill volume or rinse volume or stroke length of the agitation element. The practical effect of selecting such parameters may be difficult for a user to envision. For example, the depth of fill within the wash basket provided by a selected fill volume of water may not be readily apparent or easily perceived by the user.

Accordingly, a washing machine appliance including control features for providing an improved, e.g., more intuitive, user interface would be useful.

BRIEF DESCRIPTION OF THE INVENTION

Aspects and advantages of the invention will be set forth in part in the following description, or may be apparent from the description, or may be learned through practice of the invention.

In one exemplary embodiment, a method of operating a washing machine appliance at a remote user interface device in wireless communication with the washing machine appliance is provided. The washing machine appliance includes a cabinet, a wash tub mounted within the cabinet and configured for containing fluid during operation of the washing machine appliance, and a wash basket rotatably mounted within the wash tub. The wash basket defines a wash chamber configured for receiving laundry articles. The washing machine appliance also includes an opening defined in the cabinet. The wash basket is aligned with the opening such that the wash basket is visible and accessible through the opening. The method includes obtaining a live image of the wash basket, generating an overlay representing one or more operating parameters of the washing machine appliance, and synthesizing, in real time, the overlay and the live image. The method also includes displaying the synthesized overlay and live image on a display of the remote user interface device and receiving a control input at the remote user interface device. The method further includes directing the washing machine appliance based on the control input received at the remote user interface device.

In another exemplary embodiment, method of operating a washing machine appliance at a remote user interface device in wireless communication with the washing machine appliance is provided. The washing machine appliance includes wash basket that defines a wash chamber configured for receiving laundry articles. The method includes obtaining an image of the wash basket, generating an overlay representing one or more operating parameters of the washing machine appliance, and displaying the image and the overlay simultaneously on a display of the remote user interface device. The method also includes receiving a control input at the remote user interface device and directing the washing machine appliance based on the control input received at the remote user interface device.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
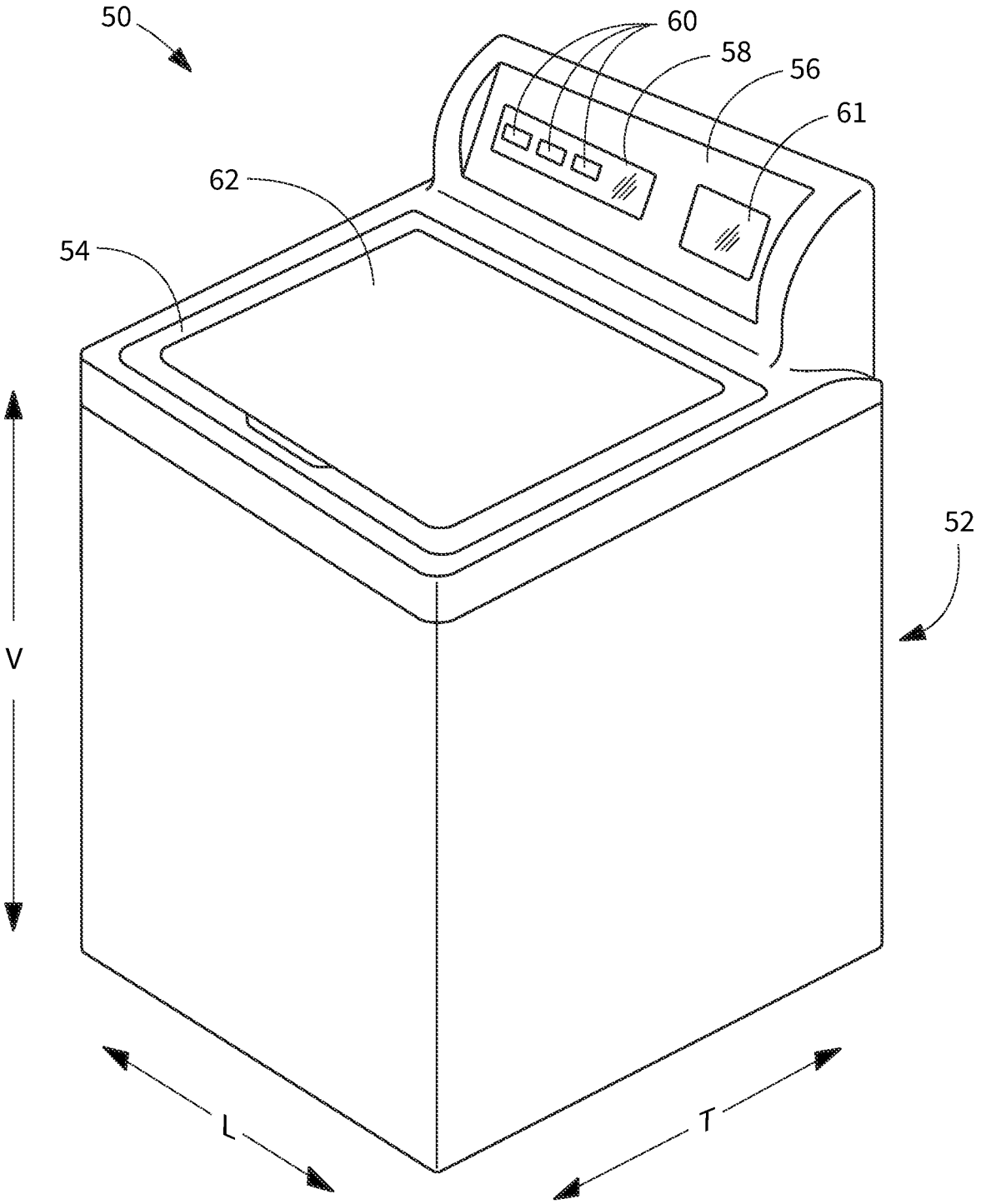
FIG. 1 provides a perspective view of a washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "clothing," "articles," and the like may include but need not be limited to fabrics, textiles, garments, linens, papers, or other items which may be cleaned, dried, and/or otherwise treated in a laundry appliance. Furthermore, the terms "load" or "laundry load" refers to the combination of clothing that may be washed together in a washing machine or dried together in a dryer appliance and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
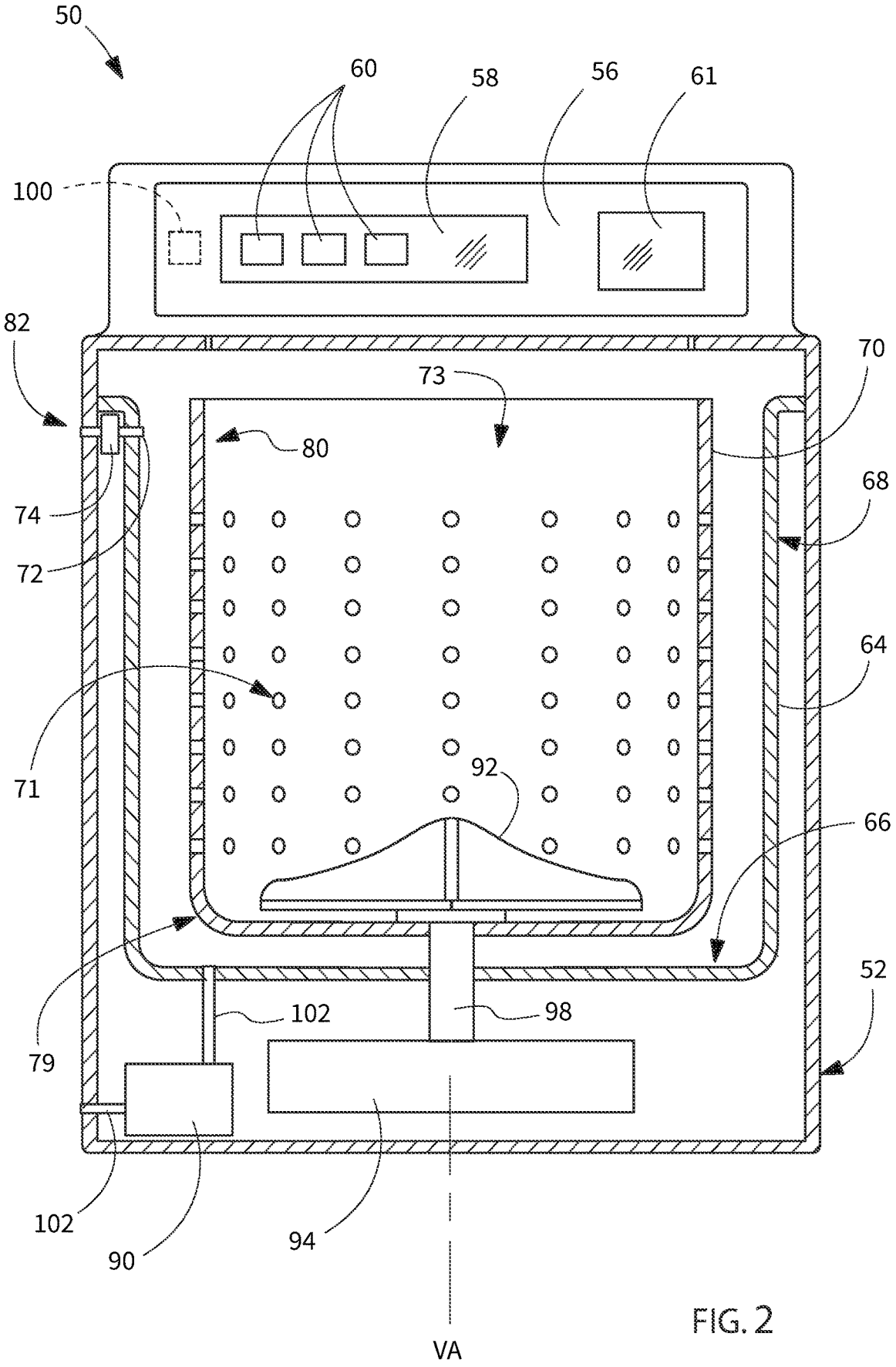
FIG. 2 provides a front, section view of the exemplary washing machine appliance of FIG. 1.

FIG. 2 provides a front, cross-section view of washing machine appliance 50. As may be seen in FIG. 2, wash tub 64 includes a bottom wall 66 and a sidewall 68. A wash basket 70 is rotatably mounted within wash tub 64. In particular, wash basket 70 is rotatable about a vertical axis VA. Thus, washing machine appliance is generally referred to as a vertical axis washing machine appliance. Wash basket 70 defines a wash chamber 73 for receipt of articles for washing and extends, e.g., vertically, between a bottom portion 79 and a top portion 80. Wash basket 70 includes a plurality of perforations 71 therein to facilitate fluid communication between an interior of wash basket 70 and wash tub 64.

An inlet or spout 72 is configured for directing a flow of fluid into wash tub 64. The spout 72 may be a part of a fluid circulation system of the washing machine appliance, such as an inlet of the fluid circulation system. In particular, inlet 72 may be positioned at or adjacent top portion 80 of wash basket 70. Inlet 72 may be in fluid communication with a water supply (not shown) in order to direct fluid (e.g., clean water) into wash tub 64 and/or onto articles within wash chamber 73 of wash basket 70. A valve 74 regulates the flow of fluid through inlet 72. For example, valve 74 can selectively adjust to a closed position in order to terminate or obstruct the flow of fluid through inlet 72. In some embodiments, the inlet 72 may be or include a drawer, such as a detergent drawer or additive drawer, through which water flows before flowing into the wash tub 64 and/or wash chamber 73. For example, in embodiments which include the drawer, the water may mix with an additive in the drawer, thereby creating a wash liquid comprising the water and the additive dissolved therein or intermixed therewith, and the wash liquid may then flow into the wash chamber 73 via the inlet 72 (which may be at least partially defined by, e.g., a wall or other portion of the drawer in such embodiments) after a certain liquid volume or level within the drawer has been reached.

A pump assembly 90 (shown schematically in FIG. 2) is located beneath tub 64 and wash basket 70 for gravity assisted flow from wash tub 64. Pump 90 may be positioned along or in operative communication with a drain line 102 which provides fluid communication from the wash chamber 73 of the basket 70 to an external conduit, such as a wastewater line (not shown). In some embodiments, the pump 90 may also or instead be positioned along or in operative communication with a recirculation line (not shown) which extends back to the tub 64, e.g., in addition to the drain line 102.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitation element 92 is oriented to rotate about vertical axis VA. Wash basket 70 and agitation element 92 are driven by a pancake motor 94. As motor output shaft 98 is rotated, wash basket 70 and agitation element 92 are operated for rotatable movement within wash tub 64, e.g., about vertical axis VA. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a processing device or controller 100, that is operatively coupled to the user interface input located on washing machine backsplash 56 for user manipulation to select washing machine cycles and features. In response to user manipulation of the user interface input, controller 100 operates the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses. It should be noted that controllers 100 as disclosed herein are capable of and may be operable to perform any methods and associated method steps as disclosed herein.

In an illustrative embodiment, laundry items are loaded into wash chamber 73 of wash basket 70, and washing operation is initiated through operator manipulation of control input selectors 60 or, as will be described further below, operator manipulation of a remote user interface device as well as or instead of the control input selectors 60. Wash tub 64 is filled with water and mixed with detergent to form a wash liquid. Valve 74 can be opened to initiate a flow of water into wash tub 64 via inlet 72, and wash tub 64 can be filled to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 may be moved back and forth in an oscillatory motion. The wash fluid may be recirculated through the washing machine appliance 50 at various points in the wash cycle, such as before or during the agitation phase (as well as one or more other portions of the wash cycle, separately or in addition to before and/or during the agitation phase).

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds. In various embodiments, the pump 90 may be activated to drain liquid from the washing machine appliance 50 during the entire drain phase (or the entirety of each drain phase, e.g., between the wash and rinse and/or between the rinse and the spin) and may be activated during one or more portions of the spin cycle.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
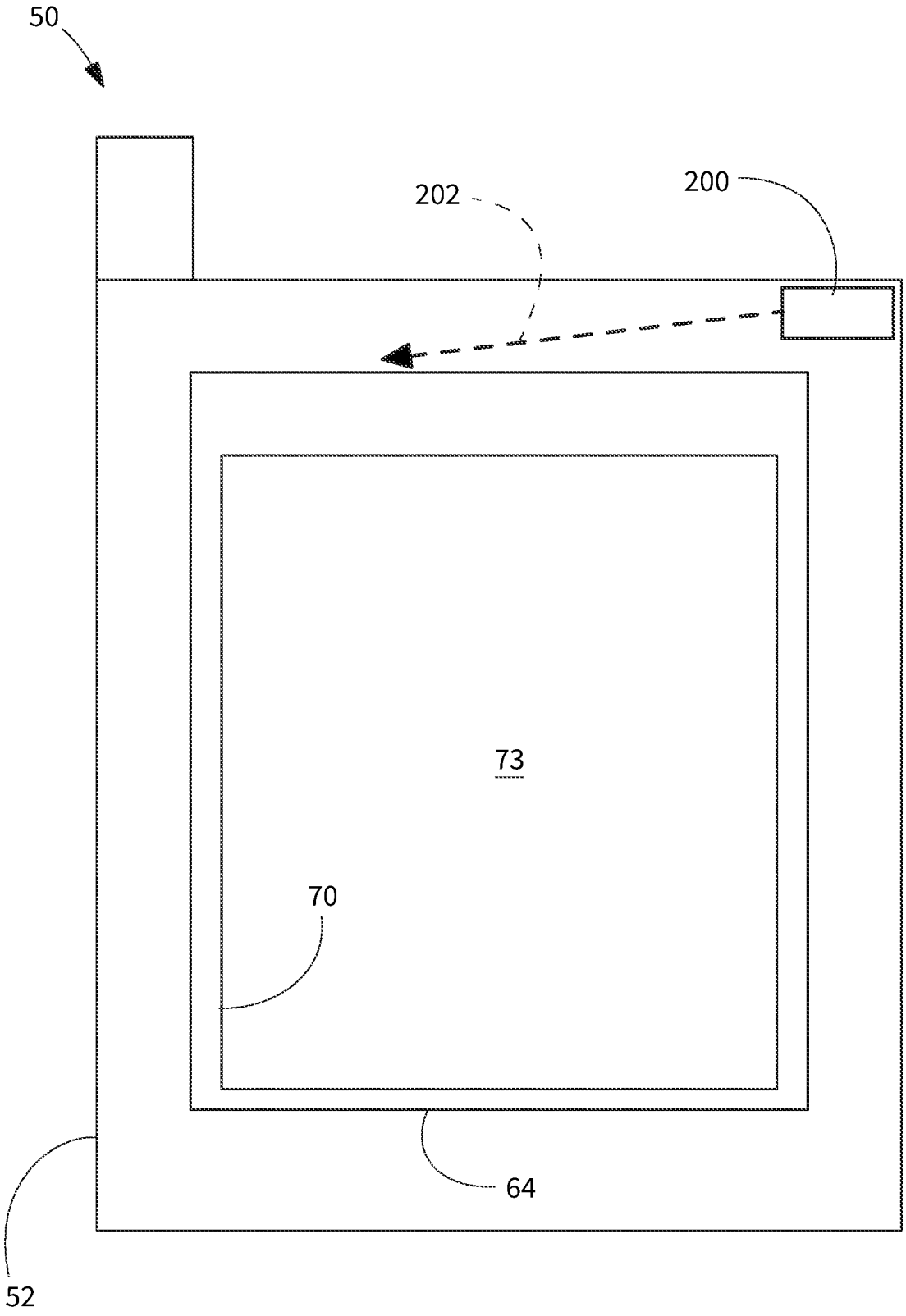
FIG. 3 illustrates a schematic side view of the exemplary washing machine appliance of FIG. 1 according to one or more exemplary embodiments of the present subject matter.
Figure 4:
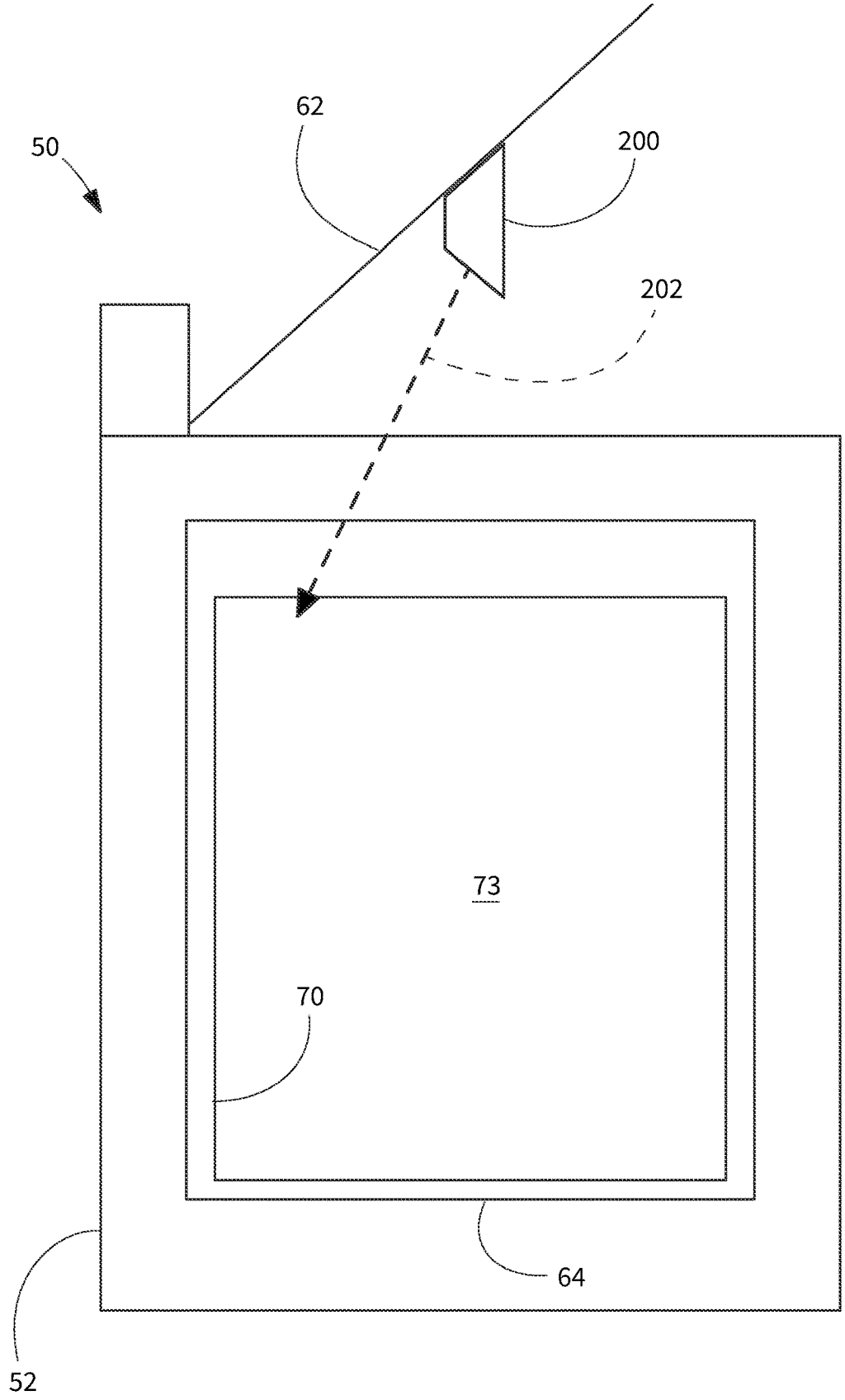
FIG. 4 illustrates a schematic side view of the exemplary washing machine appliance of FIG. 1 according to one or more additional exemplary embodiments of the present subject matter.

Referring now to FIGS. 3 and 4, washing machine appliance 50 may further include a camera 200 that is generally positioned and configured for obtaining images of wash chamber 73 of washing machine appliance 50. The camera 200 may be mounted within the cabinet 52, such as to the cabinet 52 itself, e.g., as illustrated in FIG. 3, or to the lid 62, e.g., as illustrated in FIG. 4. Specifically, camera 200 is mounted such that is faces toward the wash basket 70, whereby the wash basket 70 and the wash chamber 73 defined therein are at least partially within a field of vision, the field of vision schematically represented by arrow 202 in FIGS. 3 and 4, of the camera 200. In this manner, camera 200 can take images or video of an inside of wash chamber 73 and remains unobstructed by windows that may obscure or distort such images. In additional embodiments, images of videos of the wash chamber 73 may be obtained by a separate camera assembly (e.g., that is not directly physically connected to the washing machine appliance, such as a camera of a remote user interface device such as a smartphone or tablet computer) as well as or instead of the camera 200 illustrated in FIG. 3 or FIG. 4.

It should be appreciated that camera 200 may include any suitable number, type, size, and configuration of camera(s) 200 for obtaining images of wash chamber 73. In general, camera 200 may include a lens that is constructed from a clear hydrophobic material or which may otherwise be positioned behind a hydrophobic clear lens. So positioned, camera 200 may obtain one or more images or videos of wash chamber 73. In some embodiments, washing machine appliance 50 may further include a tub light (not shown) that is positioned within cabinet 52 or wash chamber 73 for selectively illuminating wash chamber 73 and/or contents therein.

Notably, controller 100 of washing machine appliance 50 (or any other suitable dedicated controller) may be communicatively coupled to camera 200 and other components of washing machine appliance 50. As explained in more detail below, controller 100 may be programmed or configured for obtaining images using camera 200 or obtaining images, e.g., wirelessly receiving images, from an external camera device such as a remote user interface device. The controller may obtain the images, e.g., in order to detect certain operating conditions and improve the performance of washing machine appliance 50. In addition, controller 100 of washing machine appliance 50 (or any other suitable dedicated controller) may be programmed or configured for analyzing or otherwise processing the images obtained by camera 200 (or other external camera, or combinations of multiple cameras), as described in more detail below. In general, controller 100 may be operably coupled to camera 200 (camera 200 is referred to herein throughout by way of example only, and it should be understood that an external camera may be used as well as or instead of camera 200 in each instance) for analyzing one or more images obtained by camera 200 to extract useful information regarding objects within the field of view of the one or more cameras 200. Notably, this analysis may be performed locally (e.g., on controller 100) or may be transmitted to a remote server (e.g., in the "cloud," as those of ordinary skill in the art will recognize as referring to a remote server or database in a distributed computing environment including at least one remote computing device) for analysis.

It should be appreciated that according to alternative embodiments, camera 200 may include any suitable number, type, size, and configuration of camera(s) 200, including external cameras, such as handheld camera devices, such as a remote user interface device, e.g., smartphone or tablet computer, etc., for obtaining images of any suitable areas or regions within or around washing machine appliance 50. In addition, it should be appreciated that each camera 200 may include features for adjusting the field of view and/or orientation. It should be appreciated that the images obtained by camera 200 may vary in number, frequency, angle, resolution, detail, etc., in order to improve the clarity of the particular regions surrounding or within washing machine appliance 50.

As is understood by those of ordinary skill in the art, the washing machine appliance 50, e.g., the controller 100 thereof, may communicate with one or more remote devices, such as remote computing devices and/or remote user interface devices. For example, the washing machine appliance 50 may communicate wirelessly with a remote user interface device, such as the exemplary remote user interface device 1000 in FIGS. 5 and 7, which illustrate a smartphone 1000, and the smartphone 1000 is one embodiment of a remote user interface device. For example, the washing machine appliance 50 may include an antenna by which the washing machine appliance 50 communicates with, e.g., sends and receives signals to and from, the remote user interface device 1000 and/or a network. The antenna may be part of, e.g., onboard, a communications module or other component of the controller 100, or may be a separate module instead of being onboard the controller 100. The washing machine appliance 50 may thereby be operable to connect wirelessly, e.g., over the air, to one or more other devices via any suitable wireless communication protocol. For example, such wireless communication may be in accordance with a WI-FI® protocol, a BLUETOOTH® protocol, or the washing machine appliance may include both WI-FI® and BLUETOOTH® connectivity, among other possible examples. The remote user interface device 1000 may be a laptop computer, smartphone, tablet, personal computer, wearable device, smart speaker, smart home system, and/or various other suitable devices.

The washing machine appliance 50 may be in communication with the remote user interface device 1000 device through various possible communication connections and interfaces. The washing machine appliance 50 and the remote user interface device 1000 may be matched in wireless communication, e.g., connected to the same wireless network. The washing machine appliance 50 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the washing machine appliance 50 and the remote user interface device 1000. For example, BLUETOOTH® Low Energy may advantageously minimize the power consumed by the exemplary methods and devices described herein due to the low power networking protocol of BLUETOOTH® Low Energy.

Figure 5:
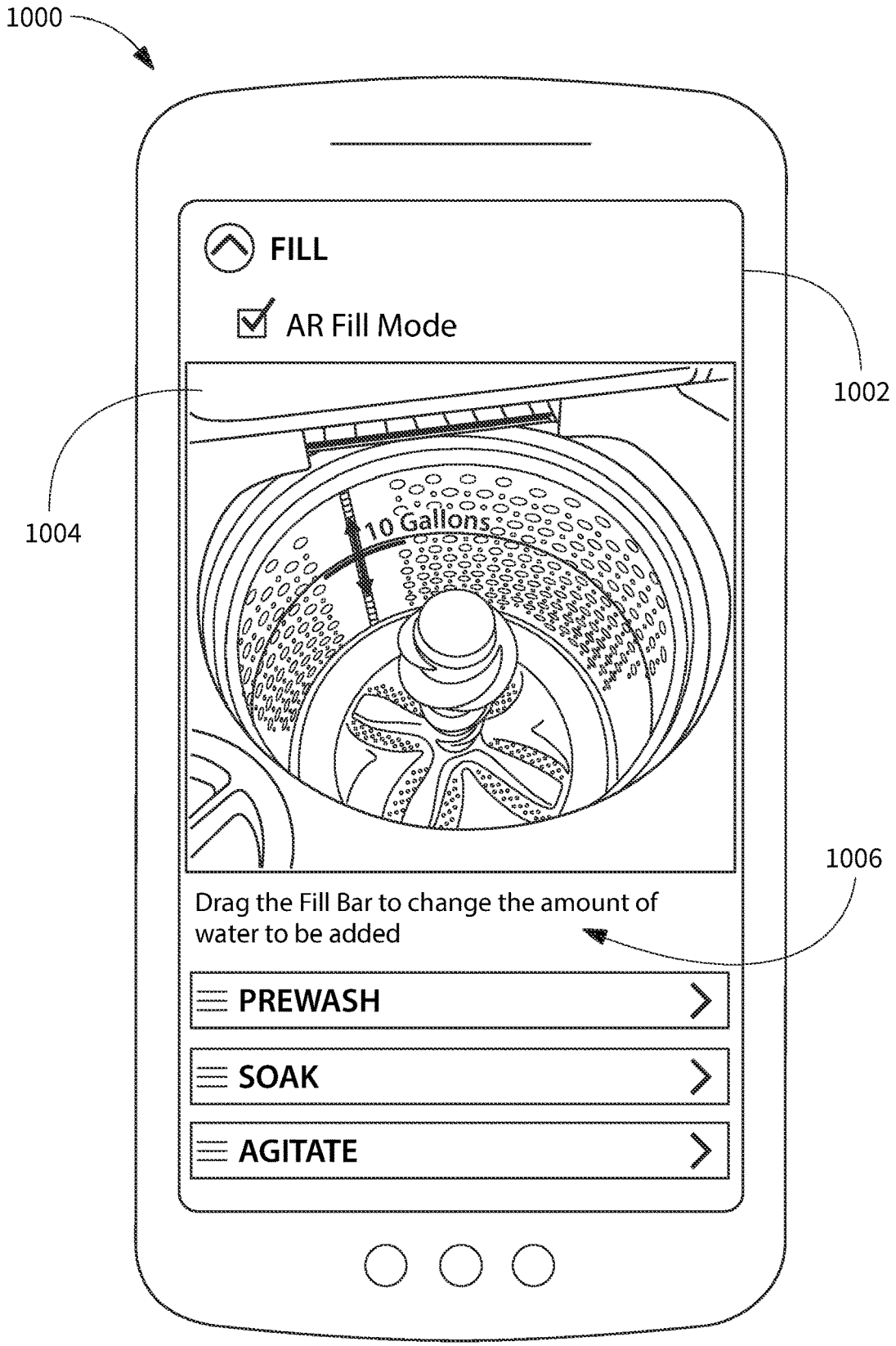
FIG. 5 illustrates an exemplary remote user interface device where the display of the remote user interface device includes an image of a washing machine appliance according to one or more exemplary embodiments of the present subject matter.
Figure 7:
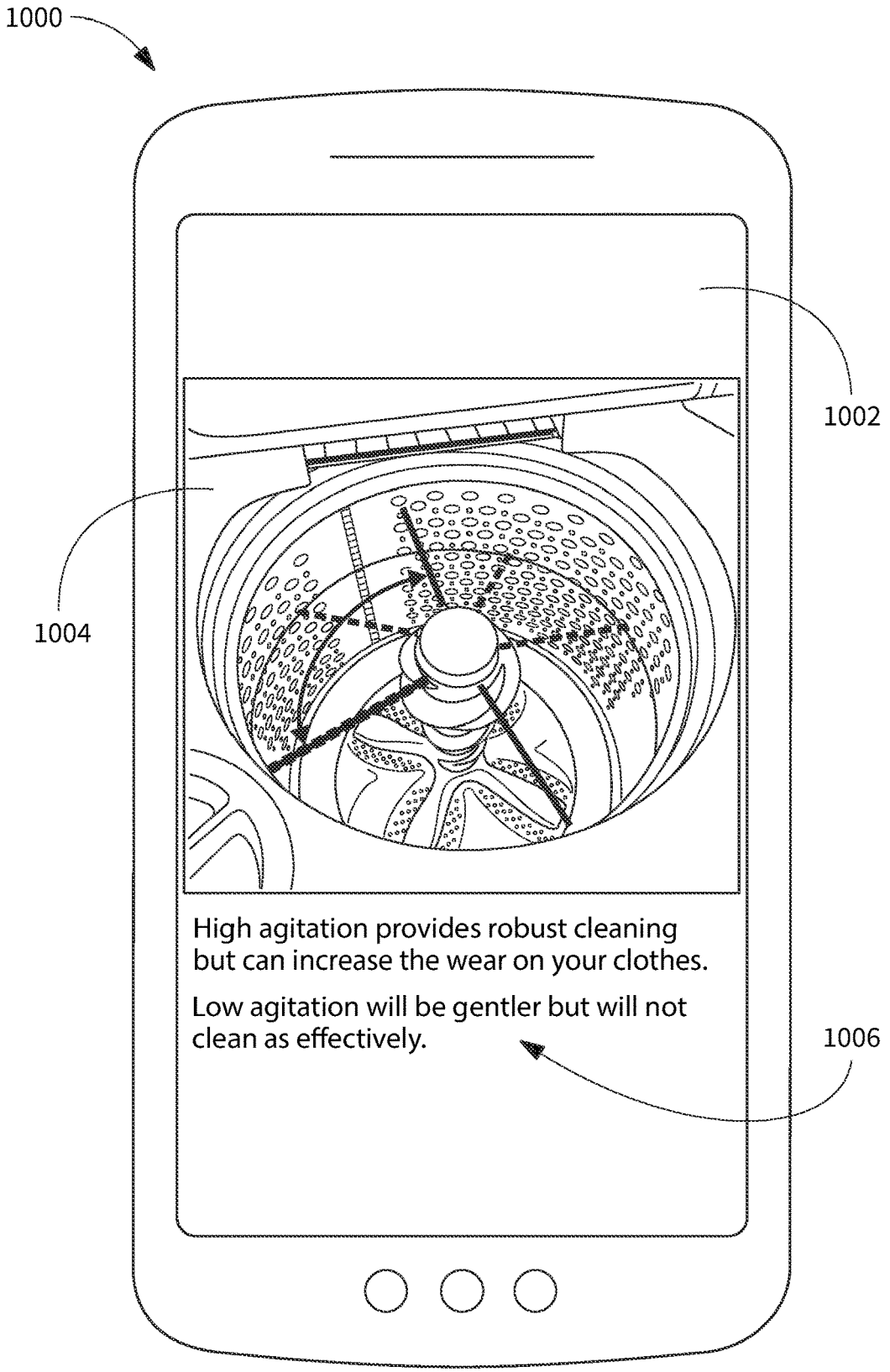
FIG. 7 illustrates the exemplary remote user interface device where the display of the remote user interface device includes another image of the washing machine appliance according to one or more additional exemplary embodiments of the present subject matter.

The remote user interface device 1000 is "remote" at least in that it is spaced apart from and not physically connected to the washing machine appliance 50, e.g., the remote user interface device 1000 is a separate, stand-alone device from the washing machine appliance 50 which communicates with the washing machine appliance 50 wirelessly. Any suitable device separate from the washing machine appliance 50 that is configured to provide and/or receive communications, information, data, or commands from a user may serve as the remote user interface device 1000, such as a smartphone (e.g., as illustrated in FIGS. 5 and 7), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the user interface panel 58. For example, the remote user interface device 1000 may be a smartphone operable to store and run applications, also known as "apps," and the additional user interface may be provided as a smartphone app.

As mentioned above, the washing machine appliance 50 may also be configured to communicate wirelessly with one or more additional remote devices, e.g., in or via a network, as well as or instead of the remote user interface device 1000. The network may be, e.g., a cloud-based data storage system including one or more remote computing devices such as remote databases and/or remote servers, which may be collectively referred to as "the cloud." For example, the washing machine appliance 50 may communicate with the cloud over the Internet, which the washing machine appliance 50 may access via WI-FI®, such as from a WI-FI® access point in a user's home.

Various examples of images which may be captured or obtained by the camera 200 and/or the camera of the remote user interface device 1000 are illustrated in FIGS. 5 through 8. As is generally seen throughout FIGS. 5 through 8, the images generally include at least a portion of the wash chamber 73 within the frame of the image.

The image or images obtained by or with the camera, e.g., such as the example images illustrated in FIGS. 5 through 8, may be analyzed to determine the size, proportion, and/or position of various components of the washing machine appliance, such as the wash basket, the wash chamber defined in the wash basket, and/or an agitation element positioned in the wash chamber, based at least in part on the one or more images, e.g., based on an image processing algorithm and a machine learning image recognition process. Each of these image evaluation processes will be described below according to exemplary embodiments of the present subject matter. It should be appreciated that image processing and machine learning image recognition processes may be used together to provide an extra safety factor and redundant detection methods to improve the accuracy of detecting the size, proportion, and/or position of the selected components of interest. In some exemplary embodiments, such redundant or duplicative detection methods may be desirable to improve the likelihood of accurate detection.

As used herein, the term "image processing algorithm" and the like is generally intended to refer to any suitable methods or algorithms for analyzing images of wash chamber 73 that do not rely on artificial intelligence or machine learning techniques (e.g., in contrast to the machine learning image recognition process as described below). For example, the image processing algorithm may rely on image differentiation, e.g., such as a pixel-by-pixel comparison of two sequential images. Image differentiation may be used to, for example, determine if a position, location, or geometric property, e.g., shape, area, or dimension, etc., of a component changes, such as crosses a threshold, e.g., a minimum or maximum.

Additional embodiments may also include using a machine learning image recognition process instead of or in addition to an image processing algorithm. In this regard, the images obtained by the camera may be analyzed by controller 100. In addition, it should be appreciated that this image analysis or processing may be performed locally (e.g., by controller 100) or remotely, such as by using distributed computing, a digital cloud, or a remote server. According to exemplary embodiments of the present subject matter, the images obtained with the camera may be analyzed using a neural network classification module and/or a machine learning image recognition process. In this regard, for example, controller 100 may be programmed to implement the machine learning image recognition process that includes a neural network trained with a plurality of images of the wash chamber 73.

As used herein, the terms image recognition process and similar terms may be used generally to refer to any suitable method of observation, analysis, image decomposition, feature extraction, image classification, etc. of one or more images or videos taken within a wash chamber of a washing machine appliance. In this regard, the image recognition process may use any suitable artificial intelligence (AI) technique, for example, any suitable machine learning technique, or for example, any suitable deep learning technique. It should be appreciated that any suitable image recognition software or process may be used to analyze images taken by the camera, and that controller 100 may be programmed to perform such processes and take corrective action.

According to an exemplary embodiment, controller may implement a form of image recognition called region-based convolutional neural network ("R-CNN") image recognition. Generally speaking, R-CNN may include taking an input image and extracting region proposals that include a potential object, such as a particular garment, region of a load of clothes, or the size or position of the agitation element. In this regard, a "region proposal" may be regions in an image that could belong to a particular object, such as a load of articles in the wash basket. A convolutional neural network is then used to compute features from the regions proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like.

According to still other embodiments, the image recognition process may use any other suitable neural network process. For example, the image recognition process may include using Mask R-CNN instead of a regular R-CNN architecture. In this regard, Mask R-CNN is based on Fast R-CNN which is slightly different than R-CNN. In addition, a K-means algorithm may be used. Other image recognition processes are possible and within the scope of the present subject matter.

It should be appreciated that any other suitable image recognition process may be used while remaining within the scope of the present subject matter. For example, the image or images from the camera 200 (and/or other cameras such as the camera of a remote user interface device, as noted above) may be analyzed using a deep belief network ("DBN") image recognition process. A DBN image recognition process may generally include stacking many individual unsupervised networks that use each network's hidden layer as the input for the next layer. According to still other embodiments, the image or images may be analyzed by the implementation of a deep neural network ("DNN") image recognition process, which generally includes the use of a neural network (computing systems inspired by biological neural networks) with multiple layers between input and output. Other suitable image recognition processes, neural network processes, artificial intelligence ("AI") analysis techniques, and combinations of the above described or other known methods may be used while remaining within the scope of the present subject matter.

An overlay may be developed from such analysis, whereby the overlay may correspond to projected positions or alignments of components or contents within the wash chamber based on possible parameter selections. For example, the image analysis may include recognizing, determining, and/or estimating the volume of the wash chamber from the image. As another example, the image analysis may include recognizing, determining, and/or estimating the size, position, type, and/or configuration of the agitation element. In additional exemplary embodiments, one or more other components or aspects of the washing machine appliance may be recognized or otherwise analyzed from the obtained image as well as or instead of the wash chamber volume and/or agitation element.

Turning now to FIGS. 5 through 8 generally, FIGS. 5 and 7 illustrate an exemplary remote user interface device 1000.

Figure 6:
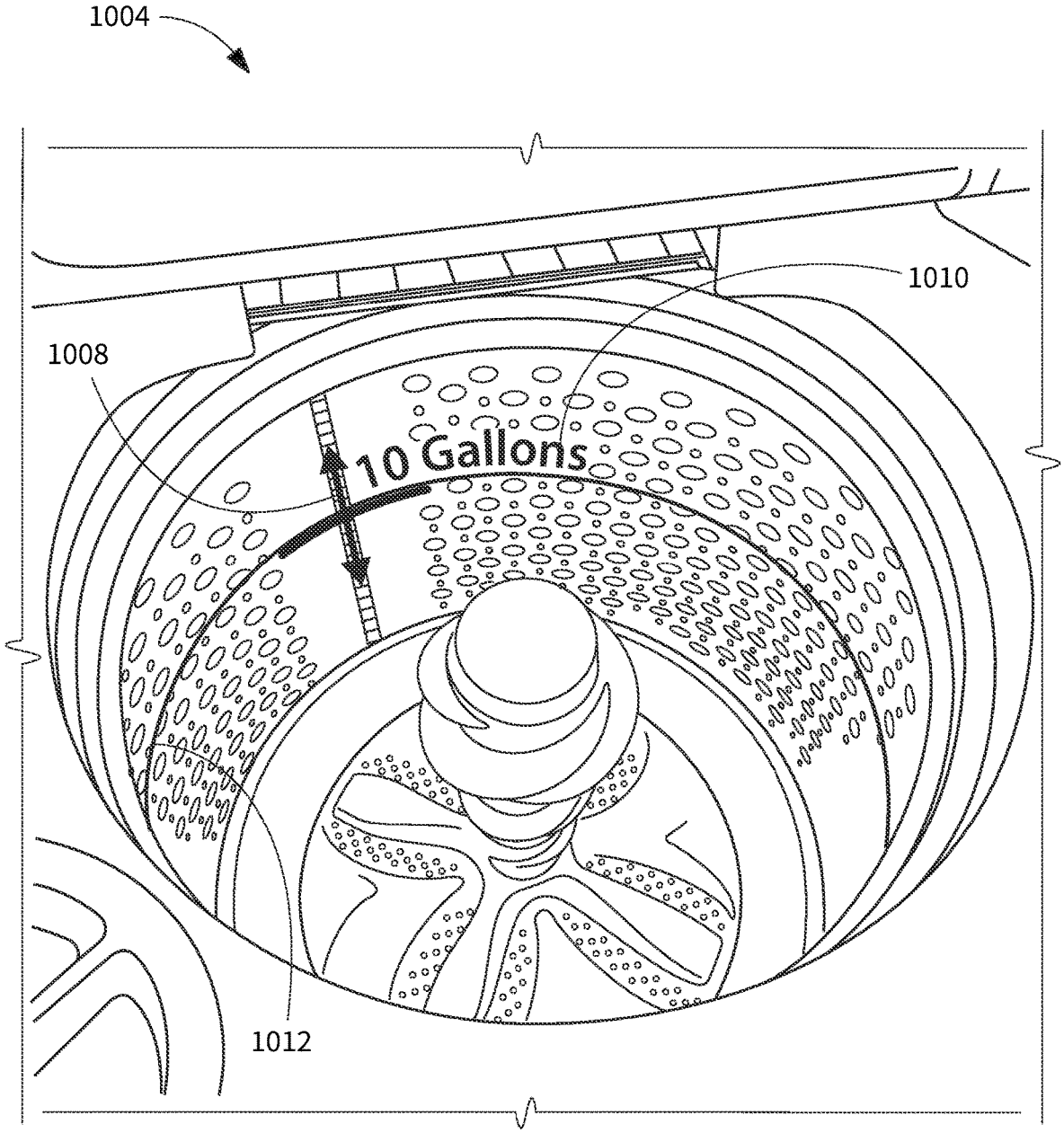
FIG. 6 illustrates an enlarged view of the image of the washing machine appliance from FIG. 5.
Figure 8:
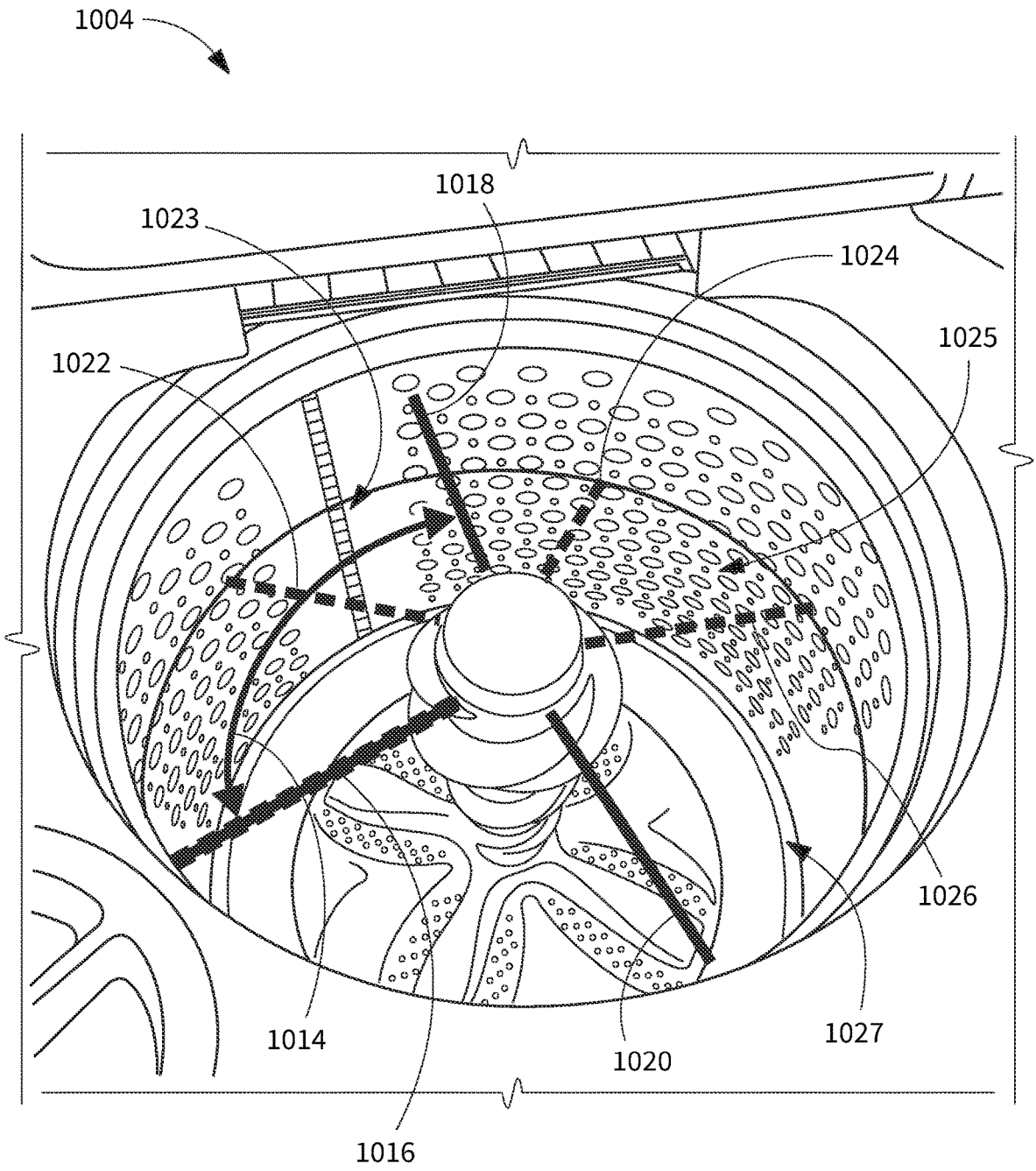
FIG. 8 illustrates an enlarged view of the image of the washing machine appliance from FIG. 7.

FIGS. 6 and 8 illustrate exemplary images 1004 which may be provided on, e.g., displayed by, a display of the remote user interface device. The remote user interface device 1000 includes a display 1002. The display includes an image 1004, which may be or include an image of the washing machine appliance 50 obtained by a camera of the remote user interface device or a camera in the washing machine appliance. The image obtained by the camera may be, for example, a live image, e.g., that is captured and displayed in real time. For example, the live image may reflect addition or removal or rearrangement of articles within the wash chamber 73. The image 1004 provided on the display 1002 of the remote user interface 1000 may be a composite or synthesized image, e.g., the image 1004 may include additional elements as well as the image obtained by the camera, such as a graphical overlay, a text overlay, or a combined overlay including both graphical elements and text elements. Further, text elements 1006 may also be provided on the display 1002 of the remote user interface device 1000 separate from and alongside the image 1004, where the text elements 1006 on the display 1002 may include explanatory text or instructions, e.g., pertaining to one or more operating parameters of the washing machine appliance 50 which may be adjusted or set using the augmented reality controls on the remote user interface device 1000.

Referring now to FIGS. 5 and 6 in particular, methods of operating a washing machine appliance according to one or more embodiments of the present disclosure may include an exemplary augmented reality (AR) fill mode, such as the exemplary augmented reality fill mode illustrated in FIGS. 5 and 6. In such embodiments, the image 1004 provided on the display 1002 of the remote user interface device 1000 may include an overlay with multiple elements. For example, as shown in FIG. 6, the elements of the overlay may include a fill bar 1008, e.g., a graphical element indicating or corresponding generally to a depth in the wash basket for a given fill volume. The fill bar 1008 may include a line representing the fill depth within the basket and one or more arrows indicating potential adjustments, e.g., up or down, of the fill level, where up represents increased fill volume and down represents decreased fill volume. For example, two arrows may be provided when the currently-selected fill volume is an intermediate volume, e.g., ten gallons as in the example illustrated in FIG. 6, whereas only a down arrow may be provided when the currently-selected fill volume is a maximum fill volume or only an up arrow may be provided when the currently-selected fill volume is a minimum fill volume. The overlay in the image 1004 may also include text elements, such as volume indicator text 1010 as illustrated in FIG. 6, where the text of the volume indicator text 1010 indicates the currently-selected fill volume. Accordingly, the volume indicator text 1010 may update in response to user input at the fill bar 1008 within the image 1004. Such user input may include, e.g., dragging, such as tapping and dragging or clicking and dragging the fill bar 1008 within the image 1004, or tapping or clicking on the up arrow or down arrow within the image 1004, among other possible user inputs. The image 1004 may also include a fill line 1012, and an area within the fill line 1012 may further be shaded, e.g., in light blue such as to represent or depict water in the wash basket, or in any other suitable color, tone, or pattern. The fill line 1012 may coincide with the fill bar 1008, may be updated in real time as the fill bar 1008 is adjusted, and may encircle the entire perimeter, e.g., circumference, of the wash basket, or the entirety of the portion of the perimeter that is visible in the image (e.g., depending on the angle of the camera and the portion of the wash basket that falls within the camera's field of view when the image is obtained).

Referring now to FIGS. 7 and 8 in particular, methods of operating a washing machine appliance according to one or more embodiments of the present disclosure may include selecting an agitation stroke length using an augmented reality interface, such as the exemplary augmented reality interface illustrated in FIGS. 7 and 8. In such embodiments, the text element 1006 (FIG. 7) provided on the display 1002 of the remote user interface device 1000 may include explanatory text related to the agitation stroke length, e.g., describing characteristics and/or results of a longer stroke length (high agitation) and a shorter stroke length (low agitation).

As illustrated in FIG. 8, the image 1004 may include a starting position indicator 1016 which corresponds to a reference position or starting position of the agitation element and an end position indicator 1018 which corresponds to an end position of the agitation element at the end of each stroke. A stroke length indicator 1014 may extend between the starting position indicator 1016 and the end position indicator 1018, e.g., from the starting position indicator 1016 to the end position indicator 1018, to indicate the selected agitation stroke length. The image 1004 may be interactive, such as by dragging the end position indicator 1018 towards or away from the starting position indicator 1016 to make the stroke length shorter or longer. Additionally, the stroke length indicator 1014 may change as the relative distance between the starting position indicator 1016 and the end position indicator 1018 changes. As another example, the agitation level may be selected by tapping on or otherwise selecting (e.g., clicking, etc.) a zone corresponding to one of several possible selectable agitation levels, such as low, medium, and high agitation zones, as will be described in more detail below, as well as or instead of selecting a specific end position via the end position indicator 1018.

Still referring to FIG. 8, the graphical overlay portion of the image 1004 may further include multiple zones, such as a low agitation zone 1023, a medium agitation zone 1025, and a high agitation zone 1027. The zones may each be shaded, and may be shaded differently from each other to aid in distinguishing the zones. For example, the low agitation zone 1023 may be shaded in green, the medium agitation zone 1025 may be shaded in yellow, and the high agitation zone 1027 may be shaded in red. In additional embodiments, any suitable color or tone may be used, such as varying shades of grey, etc., to distinguish the various zones. Additionally, in some embodiments only two zones may be included, or four or more zones may be included. A selected agitation level may be visually represented in the image 1004 based on which zone the end position indicator 1018 falls in. For example, FIG. 8 illustrates a selected low agitation level where end position indicator 1018 is in the low agitation zone 1023.

The range of possible agitation stroke lengths may be represented by a minimum end position indicator 1022 and a maximum end position indicator 1020. The low agitation zone 1023 may begin at the minimum end position 1022 and extend to a first boundary 1024. The first boundary 1024 may separate and partially define the low agitation zone 1023 and the medium agitation zone 1025. The medium agitation zone 1025 may begin at the first boundary 1024 and end at a second boundary 1026. The second boundary 1026 may separate and partially define the medium agitation zone 1025 and the high agitation zone 1027. The high agitation zone 1027 may begin at the second boundary 1026 and end at the maximum end position indicator 1020. For example, the end position indicator 1018 as illustrated in FIG. 8 is between the minimum end position indicator 1022 and the first boundary 1024 and thus the selected agitation stroke length corresponds to a low agitation selection.

Figure 9:
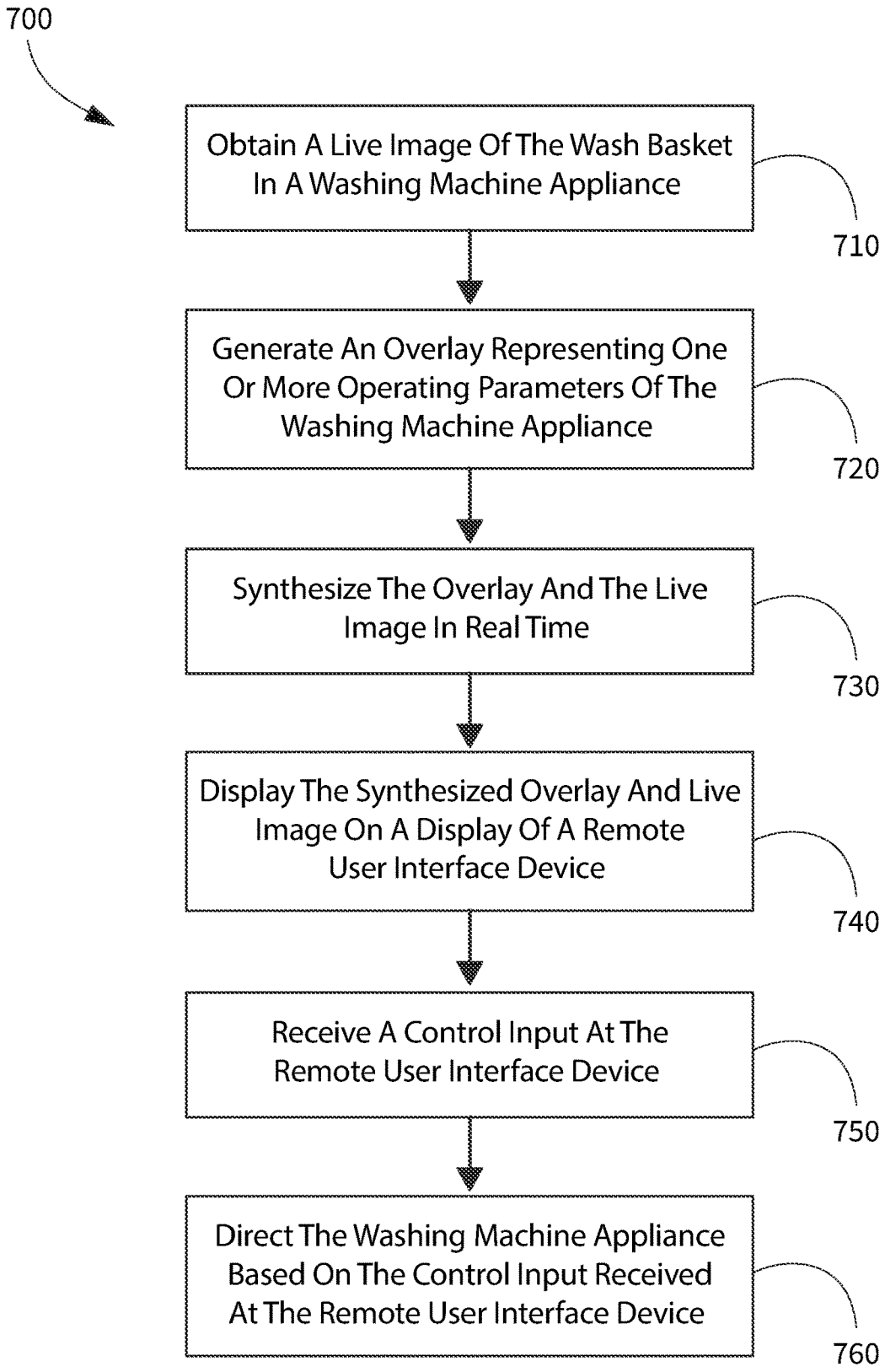
FIG. 9 provides a flow chart illustration of an exemplary method of operating a washing machine appliance according to one or more exemplary embodiments of the present subject matter.

FIG. 9 illustrates an example embodiment of a method 700 of operating a washing machine appliance according to the present subject matter. Method 700 can be used to operate any suitable washing machine appliance, such as washing machine appliance 50 (FIG. 1). Method 700 may be programmed into and implemented by controller 100 (FIG. 2) of washing machine appliance 50. However, this is only by way of example, method 700 may also be used to operate various other washing machine appliances which differ from the example washing machine appliance 50. Thus, it is to be understood that reference numbers referring to various components of the washing machine appliance are provided only for the sake of illustration in the description of the method, and the method 700 is not limited to any particular washing machine appliance. Additionally, method 700 may be performed in part by the controller of the washing machine appliance and in part by one or more external, e.g., remote, computing devices, such as a remote user interface device and/or remote computing devices in a local network or over the internet, etc.

As illustrated at step 710 in FIG. 9, in some embodiments, the exemplary method 700 may include obtaining a live image of the wash basket. The live image may be obtained with a camera in the washing machine appliance and/or with an external camera, such as a smartphone camera, tablet computer camera, or other remote user interface device having a camera. The image may be live in that the image is updated in real time or near real time on an associated display, such as the display described below in reference to step 740.

Obtaining the image of the wash basket may include obtaining one or more images. The camera may define a field of vision, and may be positioned and oriented such that the wash basket 70 and/or wash chamber 73 is or are at least partially within the field of vision of the camera. For example, the camera may be used to obtain an image or a series of images within the wash chamber 73. Thus, step 710 includes obtaining one image, a series of images/frames, or a video of wash chamber 73. Step 710 may further include taking a still image from the video clip or otherwise obtaining a still representation or photo from the video clip. It should be appreciated that the images obtained by the camera may vary in number, frequency, angle, resolution, detail, etc. In addition, according to exemplary embodiments, controller 100 may be configured for illuminating the wash basket and wash chamber using a light just prior to or while obtaining the image or images. In this manner, by ensuring wash chamber 73 is illuminated, a clear image of wash chamber 73 may be obtained.

In some embodiments, method 700 may include a step 720 of generating an overlay representing one or more operating parameters of the washing machine appliance. The overlay may be generated based on static data, e.g., based on manufacturing details of the washing machine appliance, such as an agitation element type or size or a wash basket size, etc. The overlay may also or instead be generated based on a recorded image of the washing machine appliance or of another washing machine appliance of the same or similar model. In additional embodiments, the method 700 may also include performing image analysis of the obtained live image and generating the overlay based on the image analysis, such as determining a volume of the wash basket via image analysis of the obtained live image and generating the overlay based in part on the determined volume of the wash basket. Further, in some embodiments method 700 may include estimating a volume of a load of articles in the wash basket based on the obtained live image of the wash basket, e.g., by performing image analysis of the obtained live image to estimate or determine the size of the load of articles.

Method 700 may further include a step 730 of synthesizing the overlay and the live image in some embodiments. Such synthesis may include combining and/or superimposing the overlay with or on the live image and may be performed in real time. For example, such real time analysis or synthesis may include, in some embodiments, updating the overlay in response to the control input received at the remote user interface device. The synthesized overlay and live image may, in some embodiments, be displayed on a display of the remote user interface device, e.g., as indicated at step 740 in FIG. 9.

In some embodiments, method 700 may also include displaying instructions on the display of the remote user interface device along with the synthesized overlay and live image, such as instructions for selecting a fill volume (see, e.g., FIG. 5 at 1006) or setting an agitation level (see, e.g., FIG. 7 at 1006).

In some embodiments, method 700 may further include receiving a control input at the remote user interface device. For example, in embodiments where the remote user interface includes a touchscreen display, such as when the remote user interface device is a smartphone or tablet computer, receiving the control input may include detecting a touch from a user on the touchscreen, which may include, for example, a tap, swipe, or pinch, or other similar touch input or gesture on the touchscreen. As one example, such input may include tapping or dragging a fill bar, such as fill bar 1008 (FIG. 6) and/or a stroke length indicator, such as end position indicator 1018 (FIG. 8).

Still referring to FIG. 9, in some embodiments, the method 700 may further include a step 760 of directing the washing machine appliance based on the control input received at the remote user interface device. For example, such directions may include setting a fill volume and/or an agitation stroke length or other agitation level, among various other possible operating parameters of the washing machine appliance, based on and in response to the input received at the remote user interface device.

In some exemplary embodiments, the overlay may represent a fill volume of wash liquid in the wash tub. In such embodiments, directing the washing machine appliance based on the control input received at the remote user interface device may include opening a fill valve of the washing machine appliance, such as for a fill time based on the control input.

In some exemplary embodiments, the overlay may represent a stroke length of an agitation element of the washing machine appliance. In such embodiments, directing the washing machine appliance based on the control input received at the remote user interface device may include rotating the agitation element through an arc within the wash basket, such as along an arc length based on a starting position and/or an ending position selected via the remote user interface device and/or based on a selected agitation zone selected via the remote user interface device.

Figure 10:
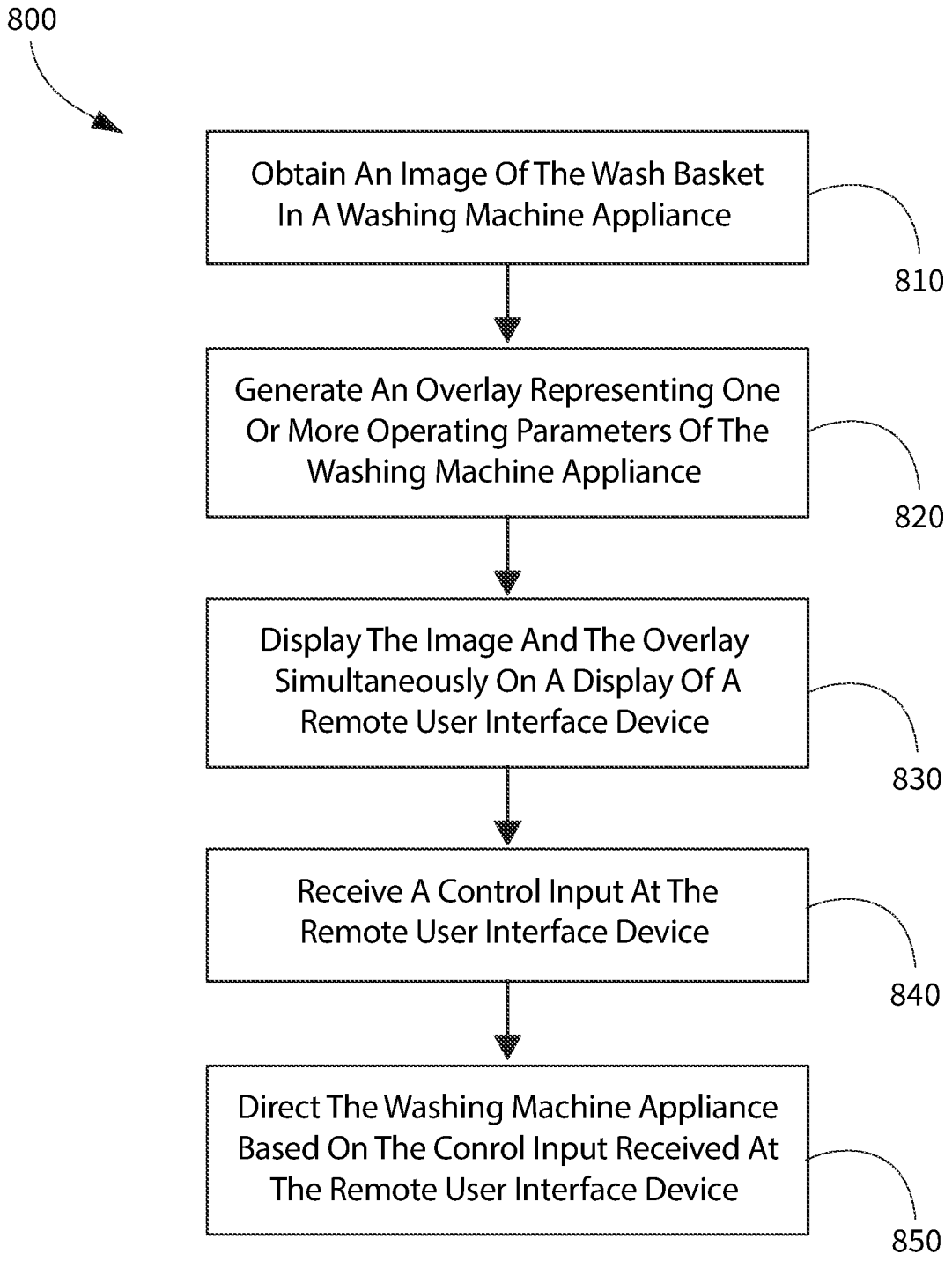
FIG. 10 provides a flow chart illustration of another exemplary method of operating a washing machine appliance according to one or more additional exemplary embodiments of the present subject matter.

Turning now to FIG. 10, another exemplary method 800 of operating a washing machine appliance at a remote user interface device is illustrated. As with method 700, method 800 may also be used to operate any suitable washing machine appliance, and references to the particular exemplary washing machine appliance 50 are by way illustration only and not intended to be limiting.

As illustrated in FIG. 10, some embodiments of method 800 may include a step 810 of obtaining an image of the wash basket, e.g., one or more images, videos, etc., using one or more cameras, in a similar manner as described above with respect to step 710 of method 700.

In some embodiments, method 800 may also include a step 820 of generating an overlay representing one or more operating parameters of the washing machine appliance. The overlay may be generated based on static data, e.g., based on manufacturing details of the washing machine appliance, such as an agitation element type or size or a wash basket size, etc. The overlay may also or instead be generated based on a recorded image of the washing machine appliance or of another washing machine appliance of the same or similar model.

Method 800 may, in some embodiments, further include displaying the image and the overlay simultaneously on a display of the remote user interface device, e.g., as indicated at 830 in FIG. 10. For example, such simultaneous display may include aligning the overlay with the image of the wash basket and superimposing the overlay on the image of the wash basket. The display of the image and the overlay may also be updated or changed in real time, such as in response to changes in the image, e.g., adding, removing, or rearranging articles in the wash basket, or changes in the overlay, e.g., in response to a user input. For example, the overlay may be updated in response to the control input received at the remote user interface device. In some embodiments, method 800 may also include displaying instructions on the display of the remote user interface device along with the synthesized overlay and live image, such as text element 1006 described above with reference to FIGS. 5 and 7.

As illustrated in FIG. 10, in some embodiments, the method 800 may include a step 840 of receiving a control input at the remote user interface device, e.g., in a similar manner as described above with respect to step 750 of method 700. Method 800 may, in some embodiments, further include a step 850 of directing the washing machine appliance based on the control input received at the remote user interface device. For example, such direction may include setting, adjusting, or establishing a fill volume or agitation level, etc., in a similar manner as described above regarding method 700.

In various embodiments, method 800 may also include one or more of the exemplary steps described above with respect to method 700. For example, the overlay in method 800 may represent a fill volume or stroke length of an agitation element, and directing the washing machine appliance may include opening a fill valve of the washing machine appliance or rotating the agitation element through an arc within the wash basket, e.g., as described above with reference to method 700. As another example, method 800 may also include obtaining the image of the wash basket by a camera of the remote user interface device or by a camera mounted in the washing machine appliance. By way of further example, method 800 may include estimating a volume of a load of articles in the wash basket based on the obtained image of the wash basket.

Referring now generally to FIGS. 9 and 10, the methods 700 and/or 800 may be interrelated and/or may have one or more steps from one of the methods 700 and 800 combined with the other method 700 or 800. Thus, those of ordinary skill in the art will recognize that the various steps of the exemplary methods described herein may be combined in various ways to arrive at additional embodiments within the scope of the present disclosure.

Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance at a remote user interface device in wireless communication with the washing machine appliance, the washing machine appliance comprising a cabinet, a wash tub mounted within the cabinet and configured for containing fluid during operation of the washing machine appliance, a wash basket rotatably mounted within the wash tub, the wash basket defining a wash chamber configured for receiving laundry articles, and an opening defined in the cabinet, the wash basket aligned with the opening whereby the wash basket is visible and accessible through the opening, the method comprising:

obtaining a live image of the wash basket;

generating an overlay representing a fill volume of wash liquid in the wash tub of the washing machine appliance, the overlay comprising a fill bar representing a fill depth within the wash basket;

synthesizing, in real time, the overlay and the live image;

displaying the synthesized overlay and live image on a display of the remote user interface device;

receiving a control input at the remote user interface device, the control input comprising moving the fill bar to a position within the live image; and directing the washing machine appliance based on the control input received at the remote user interface device, wherein directing the washing machine appliance comprises opening a fill valve of the washing machine appliance to provide a fill volume of wash liquid corresponding to the position within the live image.

2. The method of claim 1, further comprising updating the overlay in response to the control input received at the remote user interface device.

3. The method of claim 1, further comprising displaying instructions on the display of the remote user interface device along with the synthesized overlay and live image.

4. The method of claim 1, wherein the live image of the wash basket is obtained by a camera of the remote user interface device.

5. The method of claim 1, wherein the live image of the wash basket is obtained by a camera mounted in the washing machine appliance.

6. The method of claim 1, wherein the overlay is generated from static data.

7. The method of claim 1, further comprising performing image analysis of the obtained live image and generating the overlay based on the image analysis.

8. The method of claim 1, further comprising estimating a volume of a load of articles in the wash basket based on the obtained live image of the wash basket.

9. A method of operating a washing machine appliance at a remote user interface device in wireless communication with the washing machine appliance, the washing machine appliance comprising a wash basket defining a wash chamber configured for receiving laundry articles, the method comprising:

obtaining an image of the wash basket;

generating an overlay representing a stroke length of an agitation element of the washing machine appliance, the overlay comprising a starting position indicator corresponding to a starting position of the agitator and an end position indicator corresponding to an end position of the agitator;

displaying the image and the overlay simultaneously on a display of the remote user interface device;

receiving a control input at the remote user interface device, the control input comprising moving at least one of the starting position indicator and the end position indicator; and directing the washing machine appliance based on the control input received at the remote user interface device, wherein directing the washing machine appliance comprises rotating the agitation element through an arc within the wash basket, the arc defining an arc length corresponding to a distance between the starting position indicator and the end position indicator.

10. The method of claim 9, further comprising updating the overlay in response to the control input received at the remote user interface device.

11. The method of claim 9, further comprising displaying instructions on the display of the remote user interface device along with the overlay and live image.

12. The method of claim 9, wherein the image of the wash basket is obtained by a camera of the remote user interface device.

13. The method of claim 9, wherein the image of the wash basket is obtained by a camera mounted in the washing machine appliance.

14. The method of claim 9, wherein the overlay is generated from static data.

15. The method of claim 9, further comprising performing image analysis of the obtained image and generating the overlay based on the image analysis.

16. The method of claim 9, further comprising estimating a volume of a load of articles in the wash basket based on the obtained image of the wash basket.

* * * * *